US005620178A

United States Patent [19]

Jung

[11] Patent Number: 5,620,178

[45] Date of Patent: Apr. 15, 1997

[54] SHEET POST TREATMENT APPARATUS FOR STAPLING HAVING A SHEET ALIGNING MEMBER

[75] Inventor: Yeon K. Jung, Seoul, Rep. of Korea

[73] Assignee: Sindo Richo Co., Ltd., Seoul, Rep. of Korea

[21] Appl. No.: 401,247

[22] Filed: Mar. 9, 1995

[30] Foreign Application Priority Data

Mar. 10, 1994 [KR] Rep. of Korea ..... 94.4829

[51] Int. Cl.[6] ..... B65H 39/10

[52] U.S. Cl. ..... 271/293; 271/294; 271/221

[58] Field of Search ..... 271/221, 222, 271/292, 293, 294

[56] References Cited

U.S. PATENT DOCUMENTS

| | | | |
|---|---|---|---|
| 3,893,665 | 7/1975 | Greene | 271/221 |
| 3,910,568 | 10/1975 | Brown et al. | 271/221 |
| 5,090,673 | 2/1992 | Kitahara et al. . | |
| 5,099,292 | 3/1992 | Hirose | 271/221 X |
| 5,236,189 | 8/1993 | Ikoma | 271/293 X |

FOREIGN PATENT DOCUMENTS

| | | | |
|---|---|---|---|
| 102364 | 6/1985 | Japan | 271/293 |
| 52354 | 5/1991 | Japan | 271/292 |
| 74697 | 3/1992 | Japan | 271/292 |

*Primary Examiner*—Boris Milef
*Attorney, Agent, or Firm*—Keck, Mahin & Cate

[57] ABSTRACT

A sheet post treatment apparatus implementing exact and reliable sheet alignment without the need for a separate driving source for the sheet aligning bar. The apparatus includes a rotation center shaft attached to a slot liner of a side plate; a wheel fixed into the rotation center shaft and formed with a spiral groove; an eccentric cam rotating attached to the rotation center shaft; an aligning rod and a rotation lever one end of the rotation lever being connected to the eccentric cam and the other end thereof being passed through said the plate, displaced to the extent of eccentricity level of the eccentric cam; and a restoration spring, one end thereof being fixed at the side plate and the other end thereof being hung up on one side of the rotation lever. Alternate embodiments include driving the rotation lever through a bevel arrangement, and providing a moving pin on the eccentric to drive the rotation lever.

3 Claims, 8 Drawing Sheets

SHEET POST TREATMENT APPARATUS FOR STAPLING HAVING A SHEET ALIGNING MEMBER

BACKGROUND OF THE INVENTION

The present invention relates to a sheet post treatment apparatus applied to a stapler sorter attached to the sheet discharge part of an office machinery, like a copying machine or a facsimile, and comprising multiple bin trays which, through ascending or descending operations at regular intervals, successively separate and carry sheets discharged from said sheet discharge part by or in the order of pages and stapling sheets received in said bin tray and, in particular, relates to an sheet host treatment apparatus aligning sheet received in said bin tray for stapling within certain limits.

A traditional sheet post treatment apparatus, like the one proposed in the U.S. Pat. No. 5,090,673, is briefly explained in the following, using FIGS. 1 and 2.

FIG. 1 is a perspective view which roughly shows one embodiment of a traditional sheet post treatment apparatus and FIG. 2 is a top plan view which shows the operation of the traditional sheet post treatment apparatus.

In FIGS. 1 and 2, the numbered parts are the following: 101 bin unit housing, 101A vertical frame, 101B lower frame, 102 bin cover, 103 bin slot, 104 bin roller, 105 bin tray, 106 slot, 107 upper arm, 108 lower arm, 109 rotation center shaft, 110 sector gear, 111 aligning rod, 112 aligning rod driving motor, 113 output gear, 114 alignment reference plate, 115 stapler.

As shown in FIGS. 1 and 2, when the sheet discharge part discharges sheets, the sheet post treatment apparatus applied to a stapler sorter moves and aligns the sheets to a site available for stapling. To said sheet discharge part are attached the bin unit housing 101 consisting of a vertical frame 101A and a lower frame and the designated bin cover 102 whose two side ends are supported by vertical frames 101A. The bin tray 105 is equipped with two bin rollers 104 which move up and down along bin slots 103 formed in rear vertical frames 101A' of said bin unit housing 101 and the fan-shaped slot 106 of designated size is formed in a designated site of said bin tray 105. To one side of the bin cover 102 and the lower frame 101B are attached two ends of the rotation center shaft 109 which forms one unit with the upper arm 107 and the lower arm 108, and the circular arc-shaped sector gear 110 is equipped in the lower end of the lower arm 108 of said movement center shaft 109. The aligning rod 111 is connected to the upper arm 107 and the lower arm 108 of said rotation center shaft 109 and equipped to be inserted in the slot 106 of said bin tray 105. The aligning rod 111 is rotated to move and align sheets discharged from the sheet discharge part to one side of the bin tray 105 for stapling by the stapler 115.

The aligning driving motor 112 is equipped in a designated lower end part of said bin unit housing 101 and is impressed and driven by an external power supply. The output gear 113 equipped in the shaft of the aligning rod driving motor 112 transmits driving power engaged with the sector gear 110.

The alignment reference plate 114 in FIG. 2 is equipped at one side of the bin tray 105 and helps the alignment of one side of the sheets moved to the stapling site of said stapler 115.

The aforementioned traditional sheet post treatment apparatus moves and staples sheets discharged from the sheet discharge part and received in the bin tray at the stapling site of the stapler by an aligning rod rotated by the driving power of the aligning rod driving motor.

The aforementioned traditional sheet post treatment apparatus executes sheet alignment by being equipped with a separate driving power source for the sheet stapling but said separate driving power source and additional driving power source control devices enhance manufacturing costs and require additional space for attachment, thus results in the problem of having a big machinery size. In particular, small size machinery having sheet sizes of two varieties or less have less efficiency regarding increased costs and additional space and a problem in that it is impossible to align sheets having sizes beyond the coverage of rotation capacity of the aligning rod.

Another type sheet post treatment apparatus was suggested to implement sheet stapling in a small size machinery having sheet sizes of two varieties or less.

FIG. 3 is a block diagram of the essential parts showing one embodiment of this type sheet post treatment apparatus and FIG. 4 is a cross-sectional view from side 'A'.

In FIGS. 3 and 4, the numbered parts are the following: 131 bin tray, 132 tab, 133 bin tray pin, 134 aligning rod, 135 slot, 136 copying sheet, 137 sheet discharge site.

As shown in FIGS. 3 and 4, multiple bin tray 131 carry sheets 136 discharged from the sheet discharge part through ascending or descending operations at regular intervals. The bin tray 131 has a rectangle-shaped slot 135 formed on the top side of the bin tray and is equipped with an aligning rod 134 having a predetermined position and being inserted into said slot 135. The aligning rod 134 has parts of designated length forming an inclined side to one side at a predetermined angle to help the alignment of the copying sheets 136 discharged when the bin tray 131 moves up and down to receive sheets.

Examining the operation of the sheet post treatment apparatus according to said structure, copying sheets 136 discharged from the sheet discharge part of office machinery like a copying machine are carried in the bin tray 131 by its own weight thereof and then the bin tray 131 carried with copying sheets 136 moves up and down and, during said processes, one side of copying sheets 136 carried in the bin tray 131 is moved to a stapling site (not shown in FIGS. 3 and 4) by the inclined side of the aligning rod 134 and stapled.

A traditional sheet post treatment apparatus structured and operated through aforementioned processes enables a saving of installation spaces and a cut in manufacturing costs by simply transforming the shape of the aligning rod inserted in the slot of the bin tray, thus allowing the alignment of the copying sheets without a driving power source but it has two main problems: first, the sheet alignment by the inclined side is not effectively executed due to factors like a bending of copying sheets carried in the bin tray during the alignment process and second, the sheet alignment implementation by the structural formation of the inclined sides of the aligning rod is not flexibly adapted to various sheet sizes.

SUMMARY OF THE INVENTION

It is therefore an object of the present invention to eliminate the aforementioned problems by providing a sheet post treatment apparatus which aligns discharged sheets in a certain limited area of a bin tray available for stapling by forming a simple structure having an aligning rod rotated by eccentric power, using the driving power source of stapler sorter moving multiple bin trays up and down.

In order to attain the foregoing objects, the present invention provides a sheet post treatment apparatus for stapling, applied to a stapler sorter positioned at a sheet discharge part of a copying machine and equipped with a side plate having a slot liner of a designated size, comprising: a plurality of bin trays formed with an aligning groove of designated size at one side of each bin tray to provide a moving path for aligning operation; a rotation center shaft located at outside of the side plate and closely attached to upper and lower ends of the slot liner, and rotated by an external driving power; a bin tray moving means for moving said each bin tray upward or downward at certain intervals, engaged with a bin pin of said bin tray protruded from the slot liner, thus providing a sheet receiving space for discharged sheets; at least one of cam means located in one end of said bin tray moving means and eccentrically attached to said rotation center shaft; an aligning means, one end thereof is connected to one side of said cam means and other end thereof is passed through the side plate, and displaced to an extent of eccentricity level of driving of said cam means; and a restoration spring, one end thereof is fixed at the side plated and other end thereof is hung up on one side of said aligning means, providing said aligning means with the restoration power to be restored to the original position of the aligning means after said aligning means is rotated by the rotation power of the cam means.

It is another object of the present invention to provide, in a sheet post treatment apparatus for stapling applied to a stapler sorter positioned at both ends of sheet discharge part of a copying machine and equipped with a side plate having a slot liner of designated size, comprising: a plurality of bin trays formed with an aligning groove of designated size at one side of each bin tray to provide a moving path for aligning operation; a rotation center shaft located at outside of the side plate and closely attached to upper and lower ends of the slot liner, and rotated by external driving power; a bin tray moving means for moving said each bin tray upward or downward at certain intervals, engaged with a bin pin of said bin tray protruded from said slot liner, thus providing a sheet receiving space for discharged sheets; at least one of cam means located in one end of said bin tray moving means and eccentrically attached to said rotation center shaft; a moving means of a designated size equipped at one side of upper end of said cam means; and an aligning means one side thereof is formed with a guide hole of designated size for said moving means to be inserted and guided and other side thereof is passed through the side plate and displaced to an extent of eccentricity level of driving said cam means.

It is still another object of the present invention to provide, in a sheet post treatment apparatus for stapling applied to a stapler sorter positioned a sheet discharge part of a copying machine and equipped with a side plate having a slot liner of a designated size, comprising: a plurality one of bin trays formed with an aligning groove of designated size at one side of each bin tray to provide a moving path for aligning operation; a rotation center shaft located at outside of the side plate and closely attached to upper and lower ends of the slot liner, and rotated by an external driving power; a bin tray moving means for moving upward or downward bin pins of said bin tray one by one, and providing a sheet receiving space of said bin tray, attached at outer side of said side plate, facing the slot liner; a power transmitting means for transmitting a driving power of said rotation center shaft to said bin tray moving means, one part thereof is inserted into one end of said rotation center shaft and other part thereof is attached to one side of said bin tray moving means; a cam means for rotating eccentrically, attached to a designated site of upper end of said rotation center shaft; a moving means of a designated size equipped at one side of upper end of said cam means; and an aligning means, one side thereof is formed with a guide hole of designated size for said moving means to be inserted and guided and other side thereof is passed through said side plate and, through rotation, displaced to an extent of eccentricity level of said cam means.

BRIEF DESCRIPTION OF THE DRAWINGS

The above and other objects, features and advantages of the present invention will be clearly understood from the following detailed description taken in conjunction with the accompanying drawings, in which.

DETAILED DESCRIPTION OF THE PREFERRED EMBODIMENTS

Figure 1:
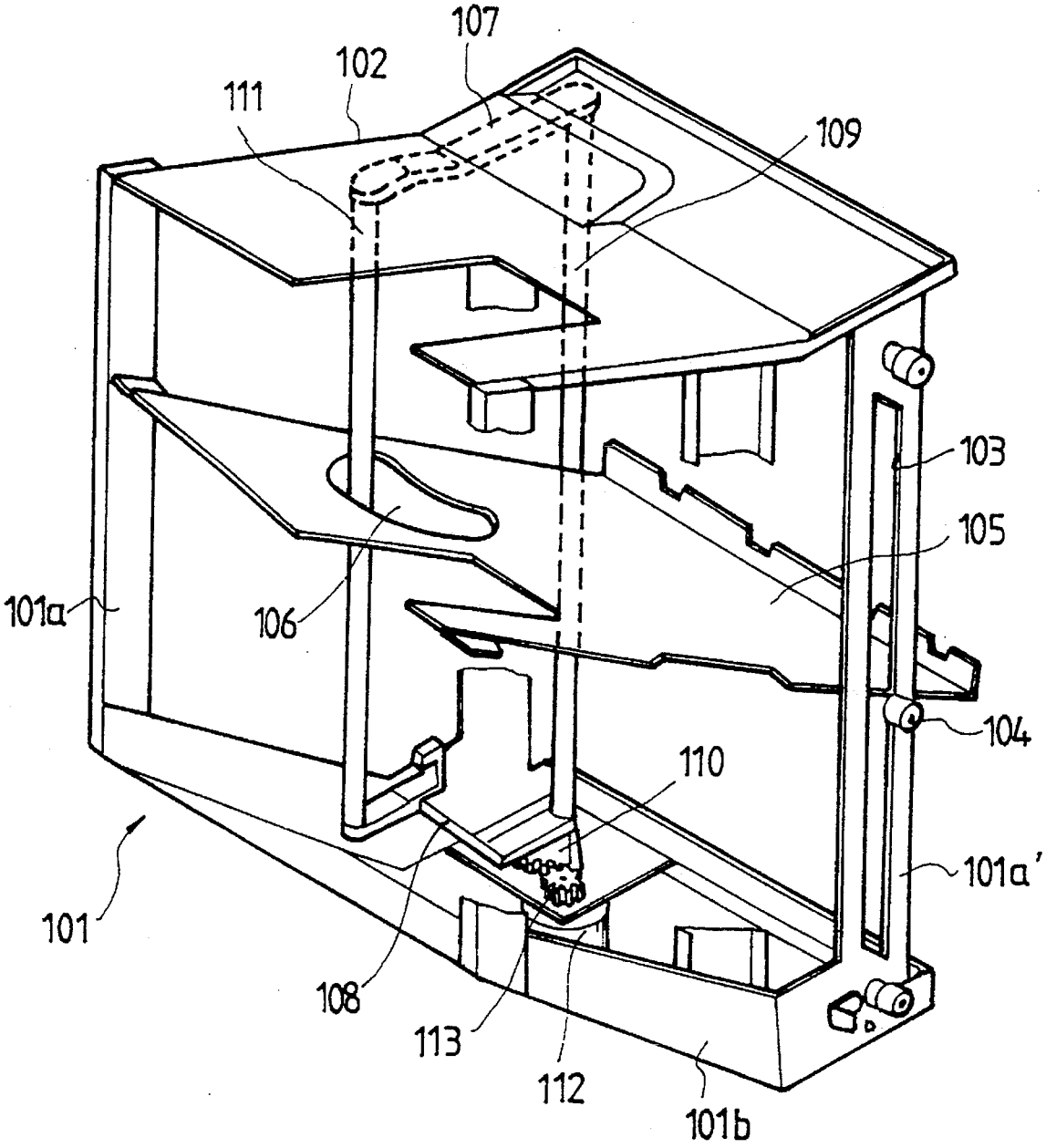
FIG. 1 (PRIOR ART)
FIG. 1 is a perspective view roughly showing one embodiment of the structure according to a traditional sheet post treatment apparatus.
Figure 2:
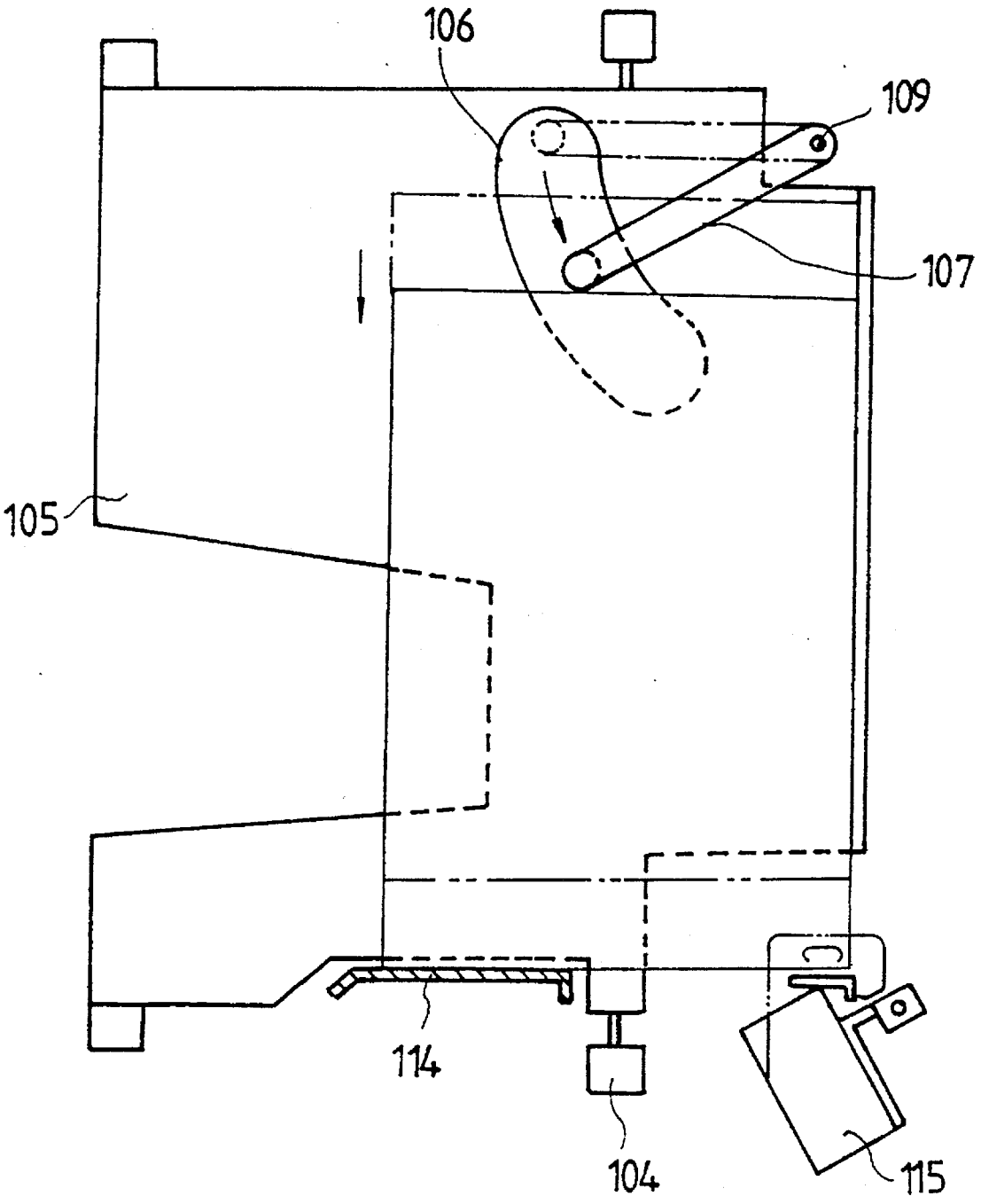
FIG. 2 (PRIOR ART)
FIG. 2 is a top plan view showing the operation situation according to a traditional sheet post treatment apparatus.
Figure 3:
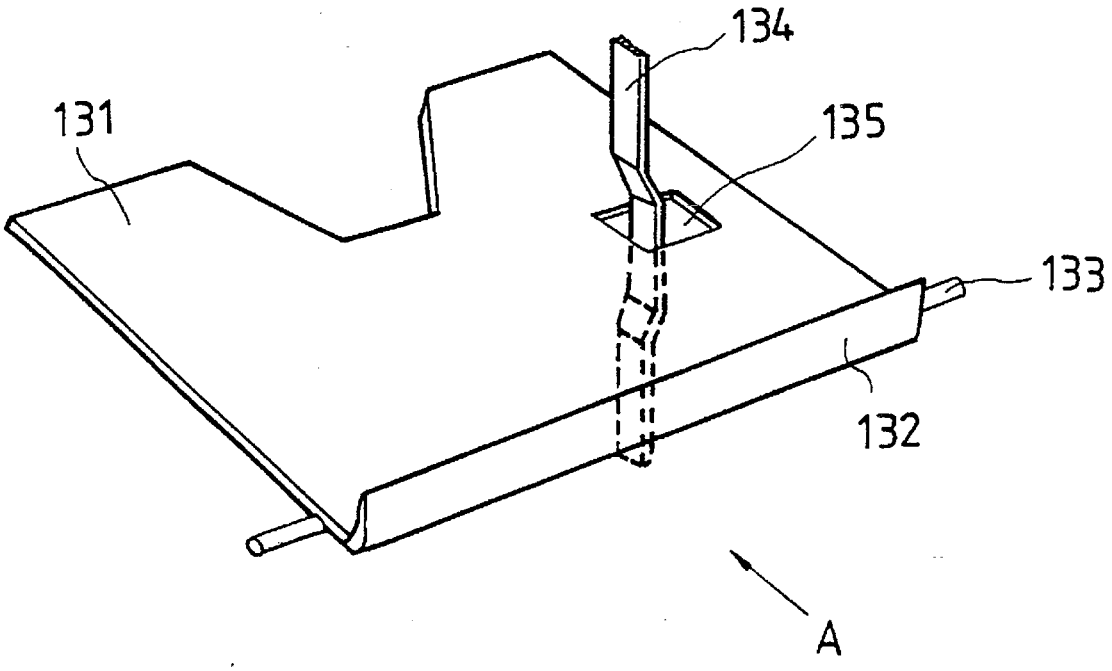
FIG. 3 (PRIOR ART)
FIG. 3 is a block diagram of essential parts showing the structure of another embodiment according to a traditional sheet post treatment apparatus.
Figure 4:
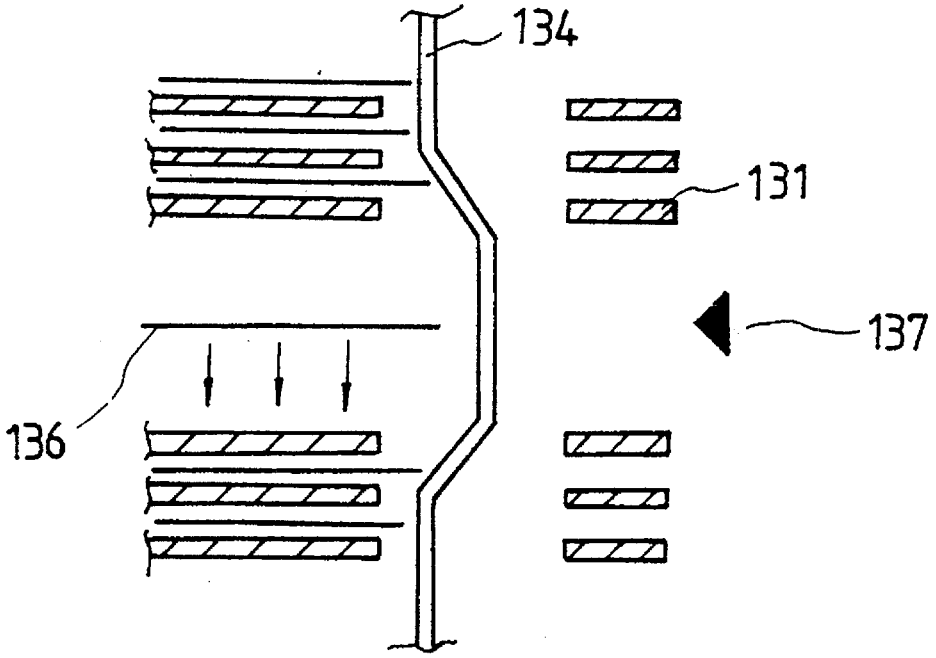
FIG. 4 (PRIOR ART)
FIG. 4 is a cross-sectional view of FIG. 3.
Figure 5:
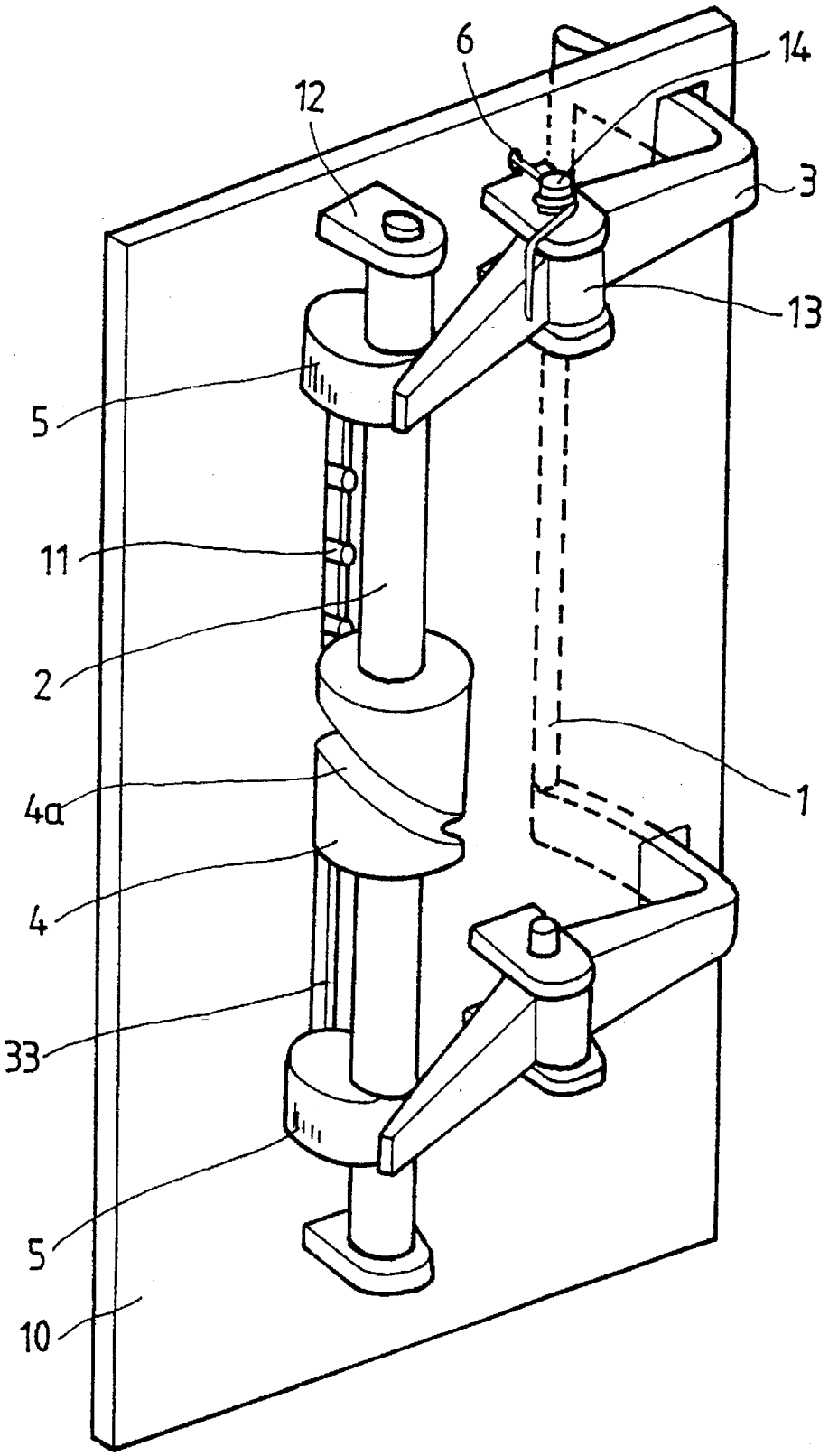
FIG. 5 is a perspective view showing the structure of one embodiment of a sheet post treatment apparatus according to the present invention.
Figure 6:
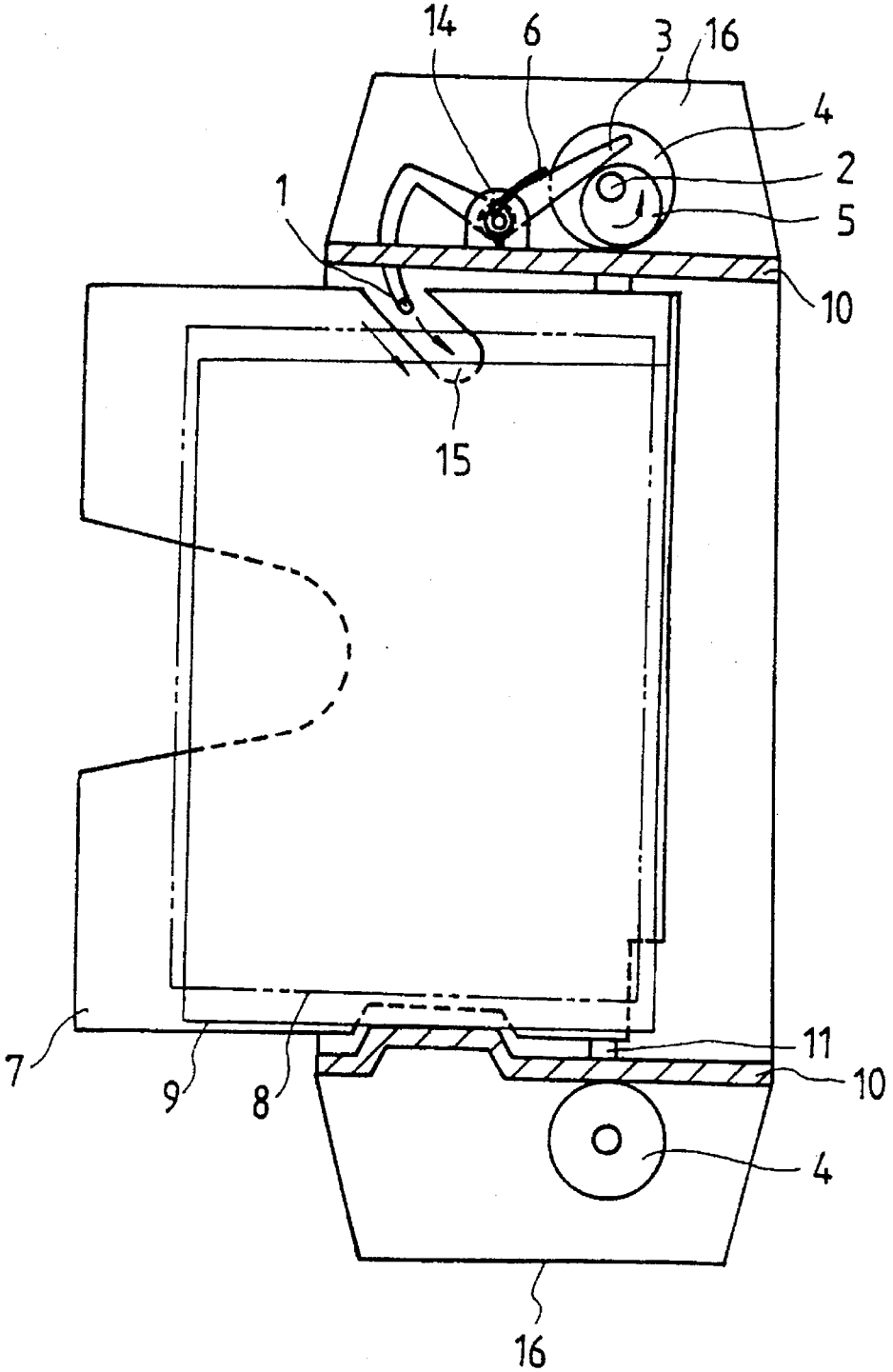
FIG. 6 is a top plan view showing the operation situation of a sheet post treatment apparatus according to the present invention.

Referring to FIGS. 5 and 6, one embodiment of the present invention is described in detail in the following.

FIG. 5 is a perspective view showing the structure of a sheet post treatment apparatus according to the present invention and FIG. 6 is a top plan view showing the operation situation of a sheet post treatment apparatus according to the present invention.

In FIGS. 5, 6, 7, and 8, the numbered parts are the following: 1 aligning rod, 2 rotation center shaft, 3 rotation lever, 4 wheel, 4A spiral groove, 5 eccentric cam, 6 restoration spring, 7 bin tray, 8 discharged sheet, 9 aligned sheet, 10 side plate, 11 bin pin, 12 fixed strip, 13 supporting strip, 14 fixed shaft, 15 aligning groove, 16 cover, 20 moving pin, 21 guide hole, 30 transfer wheel, 31 output gear, 32 reduction gear, 33 slot liner.

As shown in FIGS. 5 to 8, a sheet post treatment apparatus for the stapling of a sorter equipped with multiple bin trays separating and carrying sheets discharged from the main frame of a copying machine by or in the order of pages through ascending or descending operations at regular intervals moves and aligns discharged sheets (carried in the bin trays) to sites available for stapling. Said bin tray 7 is formed with the circular arc-shaped aligning groove 15 of a designated size at one side of the tray and equipped with the bin pins 11 of designated sizes at both sides of the tray.

At both sides of said bin tray 7 are side plates 10 formed with slot liners 33 guiding the up-and-down movement of a bin pin inserted.

The fixing strip 12 is attached to the upper and lower sides of the slot liner 33 on the outside of said side plate 10 and the rotation center shaft 2 derived by an external power is inserted in said fixing strip 12. The wheel 4 of a designated size is fixed into the central part of said rotation center shaft 2 and said wheel 4 is formed with the spiral groove 4A revolving around the rotation center shaft moving upward or downward bin pins 11 inserted in the slot liner 33 one by one.

Designated eccentric cams 5 are fixed into the upper and lower parts of the rotation center shaft equipped in said one side plate 10.

Lattice-shaped rotation lever 3 is equipped and one end thereof is connected to the surface of said eccentric cam 5, and the other end thereof is passed through the side plate 10 and forms one body united to the aligning rod 1 of a designated size.

The aligning rod is displaced to the extent of the eccentricity level of said eccentric cam 5 through rotation.

The central part of said rotation lever 3 is inserted in and supported by the supporting slip 13 and one side thereof is fixed at said side plate 10.

A restoration spring 6 is equipped to provide restoring force to the original position of said rotation lever 3 after the rotation lever is rotated by the eccentric cam 5. One end of the restoration spring is fixed at said side plate near the upper end of the supporting slip 13 and the other end thereof is fixed around the fixed shaft 14 of said supporting slip 13 and hung up on one side of the rotation lever 3. The aligning rod is guided along the aligning groove 15 formed at one side of said bin tray 7 which moves and aligns the discharged sheets 8 to the site available for stapling.

The operation of the present invention structured as above mentioned is explained as follows:

Discharged sheets 8 discharged from the sheet discharge part are received in the tray 7 by or in the order of pages. Then said rotation center shaft 2 is rotated by an external power supply and the wheel 4 inserted in the rotation center shaft moves upward or downward bin pins 11 of the bin tray 7 one by one, and eccentric cams 5 inserted in the upper and lower ends of said rotation center shaft 2 rotates the rotation lever 3 to the extent of the eccentricity level of the cam. Then the aligning rod 1 is guided along the aligning groove 15 which moves and aligns the discharged sheets 8 to the site available for stapling.

Figure 7:
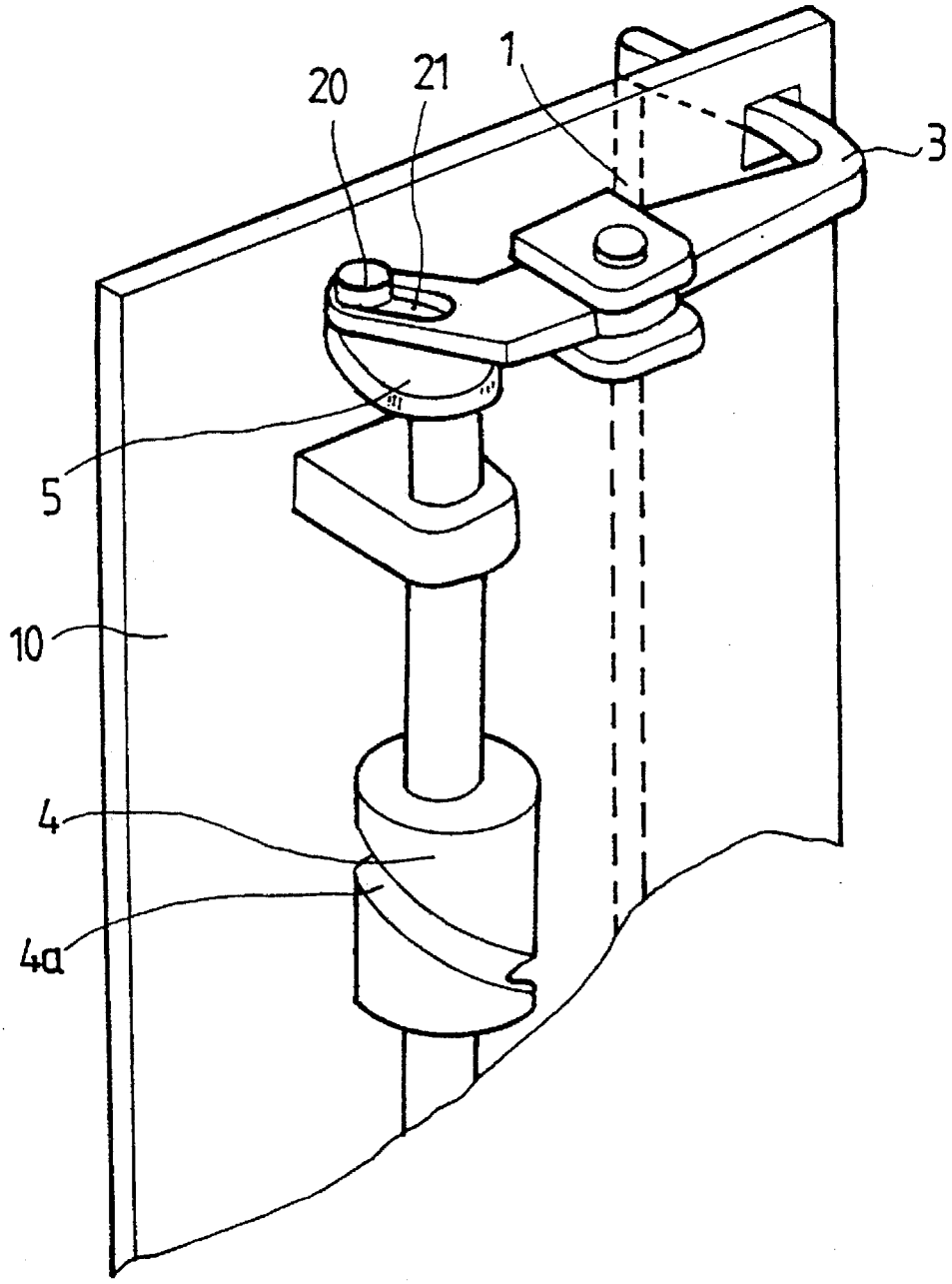
FIG. 7 is a perspective view showing the second embodiment of a sheet post treatment apparatus according to the present invention.

FIG. 7 is a perspective view showing the second embodiment of a sheet post treatment apparatus according to the present invention. In FIG. 7, numbered parts 20 and 21 show a moving pin and a guide hole respectively.

As shown in FIG. 7, the moving pin 20 of a designated size is equipped at the upper side of the eccentric cam located at the upper end of said rotation center shaft, and a guide hole 21 of a designated size is formed and inserted with said moving pin 20 at the one end side of said rotation lever 3 for guidance according to the rotation of the eccentric cam. This device is implemented to omit the restoration spring 6 for the restoration of the rotation lever 3 to its original position thereof as shown in FIG. 5.

Figure 8:
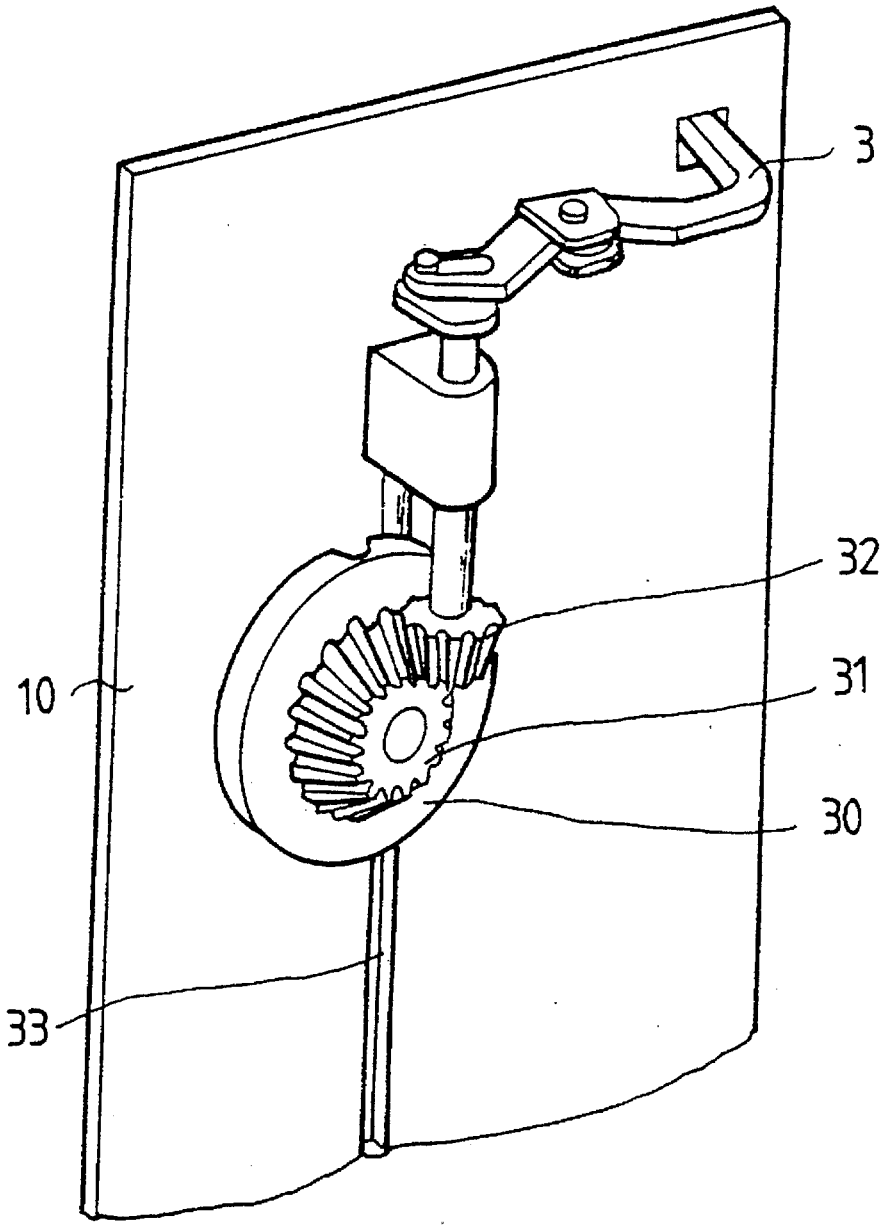
FIG. 8 is a perspective view showing the third embodiment of a sheet post treatment apparatus according to the present invention.

FIG. 8 is a perspective view showing the third embodiment of a sheet post treatment apparatus according to the present invention. In FIG. 8, numbered parts 30, 31, and 32 show a transfer wheel, an output gear, and a reduction gear respectively.

As shown in FIG. 8, the transfer wheel 30 is structured to be used as a moving means for said bin tray 7 and the driving of the transfer wheel is implemented by bevel gears. Examining the structure of the transfer wheel in detail, the designated reduction gear 32 is attached to one side of said transfer wheel 30 and the output gear 31 is attached to one end of said rotation center shaft 2 to be engaged with said reduction gear 32. Thus, when said rotation center shaft 2 rotates, the output gear 31 transmits driving power to said reduction gear 32 and the reduction gear rotates transfer wheel and, due to the rotation of the transfer wheel, bin pins 11 are moved upward or downward and aligning rod 1 is displaced by the eccentric cam 5 attached to the upper end of said rotation center shaft 2, resulting in the aligning of the discharged sheets.

The present invention operating according to the aforementioned embodiment is structured with an aligning rod which transmitted the rotation power of said cam using the driving power source of a traditional bin tray moving means. The simple structure of the present invention therefore does not need a separate driving power source and can implement exact and reliable alignment of the discharged sheets.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

We claim:

1. A sheet post treatment apparatus for stapling equipped with a side plate having a slot liner of a designated size, comprising:

a plurality of bin trays formed with an aligning groove of a designated size at one side of each bin tray to provide a moving path for an aligning operation;

a rotation center shaft located at one side of the side plate and attached closely to upper and lower ends of the slot liner;

a bin tray moving means for moving said each bin tray upward or downward at certain intervals, said bin tray moving means being engaged with bin pins of said plurality of bin trays protruding through the slot liner, thus providing a sheet receiving space for discharged sheets;

at least one cam means located at one side of said bin tray moving means and eccentrically attached to said rotation center shaft;

an aligning means, one end thereof is connected to one side of said cam means and another end thereof is passed through the side plate, and is rotated by said cam means; and a restoration spring, one end thereof is fixed at the side plate and the other end thereof is hung up on one side of said aligning means, providing said aligning means with restoration power to restore the aligning means to an original position after said aligning means is rotated by the rotation power of the cam means.

2. A sheet post treatment apparatus according to claim 1, wherein said bin tray moving means compress a wheel formed with a spiral groove revolving around said rotation center shaft.

3. A sheet post treatment apparatus for stapling equipped with a side plate having a slot liner of a designated size, comprising:

a plurality of bin trays formed with an aligning groove of a designated size at one side of each bin tray to provide a moving path for an aligning operation;

a rotation center shaft located at one side of the side plate and attached closely to upper and lower ends of the slot liner;

a bin tray moving means for moving said each bin tray upward or downward at certain intervals, said bin tray moving means being engaged with bin pins of said plurality of bin trays protruding through the slot liner, thus providing a sheet receiving space for discharged sheets;

at least one cam means located at one side of said bin tray moving means and eccentrically attached to said rotation center shaft;

a moving means of a designated size equipped at one side of an upper end of said cam means; and an aligning means, one side thereof is formed with a guide hole of a designated size for said moving means to be inserted and guided and another side thereof is passed through the side plate and, said aligning means being rotated by said cam means.

* * * * *